US010744547B2

(12) United States Patent
Nakazawa et al.

(10) Patent No.: US 10,744,547 B2
(45) Date of Patent: Aug. 18, 2020

(54) METHOD OF PRODUCING PRESS-FORMED PRODUCT

(71) Applicant: NIPPON STEEL & SUMITOMO METAL CORPORATION, Tokyo (JP)

(72) Inventors: Yoshiaki Nakazawa, Tokyo (JP); Naruhiko Nomura, Tokyo (JP); Toshiya Suzuki, Tokyo (JP); Masahiro Kubo, Tokyo (JP); Yasuhiro Ito, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 16/097,881

(22) PCT Filed: May 17, 2017

(86) PCT No.: PCT/JP2017/018535
§ 371 (c)(1),
(2) Date: Oct. 31, 2018

(87) PCT Pub. No.: WO2017/200006
PCT Pub. Date: Nov. 23, 2017

(65) Prior Publication Data

US 2019/0091748 A1 Mar. 28, 2019

(30) Foreign Application Priority Data

May 18, 2016 (JP) ..... 2016-099862

(51) Int. Cl.
*B21J 1/06* (2006.01)
*B21D 22/02* (2006.01)
(Continued)

(52) U.S. Cl.
CPC ..... *B21D 22/022* (2013.01); *B21J 1/04* (2013.01); *B21J 1/06* (2013.01); *B21J 5/00* (2013.01);
(Continued)

(58) Field of Classification Search
CPC .... B21D 22/02; B21D 22/022; B21D 22/208; B21D 35/006; B21D 53/88; B21D 37/16;
(Continued)

(56) References Cited

U.S. PATENT DOCUMENTS 5,928,604 A * 7/1999 Keil ..... C23C 8/20 266/252
7,137,201 B2 * 11/2006 Brodt ..... B21D 37/16 29/897.2
(Continued)

FOREIGN PATENT DOCUMENTS

CN 1966176 5/2007
CN 101293255 10/2008
(Continued)

OTHER PUBLICATIONS

Salzgitter Flachstahl, 22mnb5, Boron alloyed steel, Jan. 2014.*
Translation, EP 2586881 A2, May 2013.*

*Primary Examiner* — Edward T Tolan
(74) *Attorney, Agent, or Firm* — Clark & Brody LP

(57) ABSTRACT

A method of producing a press-formed product includes a steel plate heating step, a hot forging step and a hot stamping step. In the steel plate heating step, a steel plate is heated to 950° C. or more. In the hot forging step, the heated steel plate is forged to form a varying-thickness steel plate. In the hot stamping step, the heated varying-thickness steel plate is subjected to press-working by a press tooling to form a press-formed product, and the press-formed product that is formed is cooled inside the press tooling. Thus, a press-
(Continued)

formed product that has high strength and for which a reduction in weight is possible can be produced.

5 Claims, 7 Drawing Sheets

(51) Int. Cl.

| | |
|---|---|
| ***B21J 5/02*** | (2006.01) |
| ***B21J 13/10*** | (2006.01) |
| ***C22C 38/06*** | (2006.01) |
| ***B21J 5/00*** | (2006.01) |
| ***C22C 38/00*** | (2006.01) |
| ***C22C 38/58*** | (2006.01) |
| ***B21J 17/00*** | (2006.01) |
| ***B21J 1/04*** | (2006.01) |
| ***B21K 23/00*** | (2006.01) |
| ***B21J 9/08*** | (2006.01) |
| ***C22C 38/02*** | (2006.01) |
| ***C22C 38/04*** | (2006.01) |

(52) U.S. Cl.
CPC ..... *B21J 5/02* (2013.01); *B21J 5/025* (2013.01); *B21J 9/08* (2013.01); *B21J 13/10* (2013.01); *B21J 17/00* (2013.01); *B21K 23/00* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/58* (2013.01)

(58) Field of Classification Search
CPC ..... B21J 1/04; B21J 1/06; B21J 5/022; B21J 5/00; B21J 5/025; B21J 9/022; C21D 1/673; C21D 9/46
See application file for complete search history.

(56) References Cited

U.S. PATENT DOCUMENTS

| | | | | |
|---|---|---|---|---|
| 9,238,847 | B2 * | 1/2016 | Boettcher | B21D 22/022 |
| 2007/0107203 | A1 * | 5/2007 | Kroger | B62D 25/04 29/557 |
| 2009/0126451 | A1 * | 5/2009 | Hase | B21J 1/06 72/426 |
| 2019/0054513 | A1 * | 2/2019 | Hielscher | B21D 35/006 |

FOREIGN PATENT DOCUMENTS

| | | | | |
|---|---|---|---|---|
| EP | 2586881 | A2 * | 5/2013 | B21D 22/02 |
| JP | 11-104750 | | 4/1999 | |
| JP | 2002-316229 | | 10/2002 | |
| JP | 2004-353026 | | 12/2004 | |
| JP | 2005-206061 | | 8/2005 | |
| JP | 2014-226712 | | 12/2014 | |
| JP | 2015-188927 | | 11/2015 | |
| JP | 2016-059926 | | 4/2016 | |
| KR | 10-2005-0080133 | | 8/2005 | |
| KR | 10-0993988 | | 11/2010 | |
| KR | 10-2016-0002251 | | 1/2016 | |
| SU | 1558706 | | 4/1990 | |
| WO | 2010/133526 | | 11/2010 | |
| WO | 2015/092929 | | 6/2015 | |

* cited by examiner

METHOD OF PRODUCING PRESS-FORMED PRODUCT

TECHNICAL FIELD

The present invention relates to a method of producing a press-formed product composed of a steel plate, and a press-formed product production line.

BACKGROUND ART

In recent years, improvements in the fuel consumption of automobiles are being sought from the viewpoint of protecting the global environment, and there are also demands to further ensure collision safety in automobiles. Therefore, strengthening of automobile bodies and reduction in the weight thereof are being promoted. In view of this background, there is a trend toward the application of press-formed products that are made from high strength steel plates having a thin plate thickness to framework components, suspension components or the like that constitute a vehicle body (hereunder, such components are also referred to as "vehicle components"). The strength of steel plates used as the starting materials for the press-formed products is increasing more and more.

The deformability (press formability) of a steel plate decreases as the strength of the steel plate increases. Therefore, it is difficult to obtain a high quality and high strength press-formed product by performing cold press-working. As a measure to overcome this problem, there is a trend toward the adoption of hot stamping (also referred to as "hot pressing" or "press quenching") as disclosed in, for example, Japanese Patent Application Publication No. 2004-353026 (Patent Literature 1). In hot stamping, a steel plate that is the starting material is heated to, for example, around 950° C., and thereafter is supplied to a press apparatus. The steel plate is subjected to press-working by a press tooling and is simultaneously quenched.

For vehicle components, providing a difference in the plate thickness is effective for achieving a further reduction in weight while ensuring the component performance. The term "providing a difference in the plate thickness" used here refers to changing the plate thickness between a portion that governs component performance and a portion that has little influence on component performance. Conventionally, in order to provide a difference in the plate thickness of a vehicle component, a tailored blank is used as a steel plate that is supplied for press-working. Such a tailored blank is one kind of varying-thickness steel plate, and includes a portion having a large thickness (hereunder, also referred to as "thick-wall portion") and a portion having a small thickness (hereunder, also referred to as "thin-wall portion").

Tailored blanks are broadly divided into the categories of tailored welded blanks (hereunder, also referred to as "TWB") as disclosed, for example, in Japanese Patent Application Publication No. 2005-206061 (Patent Literature 2), and tailored rolled blanks (hereunder, also referred to as "TRB") as disclosed, for example, in Japanese Patent Application Publication No. 2002-316229 (Patent Literature 3). A TWB is obtained by joining together a plurality of steel plates having different plate thicknesses and the like by welding. On the other hand, a TRB is obtained by varying the plate thickness by adjusting a gap between rolling rolls that form a pair when producing a steel plate.

However, in a TWB and a TRB, a plate thickness difference between a thick-wall portion and a thin-wall portion is not particularly large. In other words, a ratio "t1/t2" between a plate thickness t1 of the thick-wall portion and a plate thickness t2 of the thin-wall portion is, at most, merely around 1.8. In addition, it cannot be denied that local strength variations that are attributable to welding occur in a TWB. In a TRB, the sizes of the respective regions of a thick-wall portion and a thin-wall portion must be reasonably large. Consequently, the degree of design freedom with respect to vehicle components is low. Accordingly, there is a limit to the degree to which the weight of a press-formed product can be lightened using a tailored blank.

CITATION LIST

Patent Literature

Patent Literature 1: Japanese Patent Application Publication No. 2004-353026

Patent Literature 2: Japanese Patent Application Publication No. 2005-206061

Patent Literature 3: Japanese Patent Application Publication No. 2002-316229

SUMMARY OF INVENTION

Technical Problem

The present invention has been made in view of the circumstances described above. One objective of the present invention is to provide a production method and a production line of producing a press-formed product having high strength and for which a reduction in weight is possible.

Solution to Problem

A method of producing a press-formed product according to an embodiment of the present invention includes a steel plate heating step, a hot forging step and a hot stamping step. In the steel plate heating step, a steel plate is heated to 950° C. or more. In the hot forging step, the steel plate is forged using a first press apparatus and a varying-thickness steel plate is formed. In the hot stamping step, a second press apparatus different from the first press apparatus is used. The hot stamping step includes press-working to form the varying-thickness steel plate into a press-formed product by means of press tooling of the second press apparatus, and cooling the press-formed product inside the press tooling.

A press-formed product production line according to an embodiment of the present invention includes a forging press apparatus, a hot stamping press apparatus, at least one heating furnace and at least one manipulator.

Advantageous Effects of Invention

According to the production method and production line of producing a press-formed product according to embodiments of the present invention, a press-formed product that has high strength and for which a reduction in weight is possible can be produced.

DESCRIPTION OF EMBODIMENTS

Figure 1:
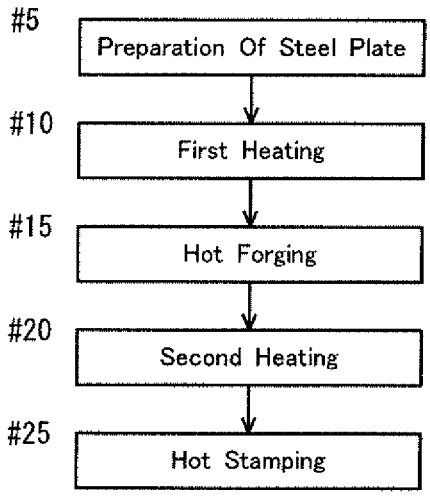
FIG. 1 is a flow chart showing a method of producing a press-formed product according to an embodiment of the present invention.

A method of producing a press-formed product according to an embodiment of the present invention includes a steel plate heating step, a hot forging step, and a hot stamping (hereunder, also referred to as "HS") step. In the steel plate heating step, a steel plate is heated to 950° C. or more. In the hot forging step, the steel plate is forged using a first press apparatus to form a varying-thickness steel plate. In the HS step, a second press apparatus different from the first press apparatus is used. The HS step includes press-working to form the varying-thickness steel plate into a press-formed product by means of press tooling of the second press apparatus, and cooling the press-formed product inside the press tooling.

In a typical example, the production method of the present embodiment also includes a preparation step. In the preparation step, a steel plate having a uniform thickness is prepared. Further, in a typical example, the production method of the present embodiment further includes a varying-thickness steel plate heating step. In the varying-thickness steel plate heating step, after the hot forging step and before the HS step, the varying-thickness steel plate is heated to a temperature that is not less than the $A_{c3}$ transformation point and is not more than "the $A_{c3}$ transformation point+150° C.". In addition, in a typical example, the production method of the present embodiment further includes a cooling step. In the cooling step, after the hot forging step and before the varying-thickness steel plate heating step, the varying-thickness steel plate is cooled. The varying-thickness steel plate in this case has a portion that has a large thickness and a portion that has a small thickness.

According to the production method that is described above, a varying-thickness steel plate in which a plate thickness difference between a portion that has a large thickness (thick-wall portion) and a portion that has a small thickness (thin-wall portion) is large can be formed by hot forging. Further, the varying-thickness steel plate can be subjected to press-working and quenching by HS, and by this means a press-formed product in which the strength of each portion is high and which has a light weight can be obtained. Thus, according to the production method of the present embodiment, a press-formed product can be produced that has high strength and, furthermore, can be dramatically lightened in weight.

A press-formed product is applied, for example, to vehicle components of an automobile. The various kinds of vehicle components include framework components (for example: pillars, side members, side sills, and cross members), suspension components (for example: toe-control links and suspension arms), and other reinforcement components (for example: bumper beams and door impact beams).

In a varying-thickness steel plate produced by the aforementioned production method, it is possible for a ratio "t1/t2" (hereunder, also referred to as "plate thickness ratio") between a plate thickness t1 of a portion that has a large thickness and a plate thickness t2 of a portion that has a small thickness to be more than 1.8. In this case, it is possible to further lighten the weight of the press-formed product. The upper limit of the plate thickness ratio "t1/t2" is not particularly limited. When taking the uniformity of press formability and quenching in the HS step into consideration, the upper limit of the plate thickness ratio "t1/t2" may be 3.5.

By using the aforementioned production method, it is possible to make the tensile strength of a press-formed product 1300 MPa or more. In this case, the component performance improves in terms of the strength and weight (weight reduction) of the press-formed product.

In the aforementioned production method, preferably the steel plate consists of, by mass %, C: 0.15 to 0.60%, Si: 0.001 to 2.0%, Mn: 0.5 to 3.0%, P: 0.05% or less, S: 0.01% or less, sol. Al: 0.001 to 1.0%, N: 0.01% or less and B: 0.01% or less, with the balance being Fe and impurities. The steel plate may contain, in lieu of a part of Fe, 0.03 to 1.0% in total of one or more types of element selected from the group consisting of Ti, Nb, V, Cr, Mo, Cu and Ni. In this case, the tensile strength of the press-formed product can be made 1300 MPa or more.

A press-formed product production line according to an embodiment of the present invention includes a forging press apparatus, a HS press apparatus, at least one heating furnace and at least one manipulator. According to the production line of the present embodiment, the aforementioned press-formed product can be produced.

Hereunder, the respective embodiments of the production method and production line for producing a press-formed product of the present invention are described in detail.

Production Method

Figure 2:
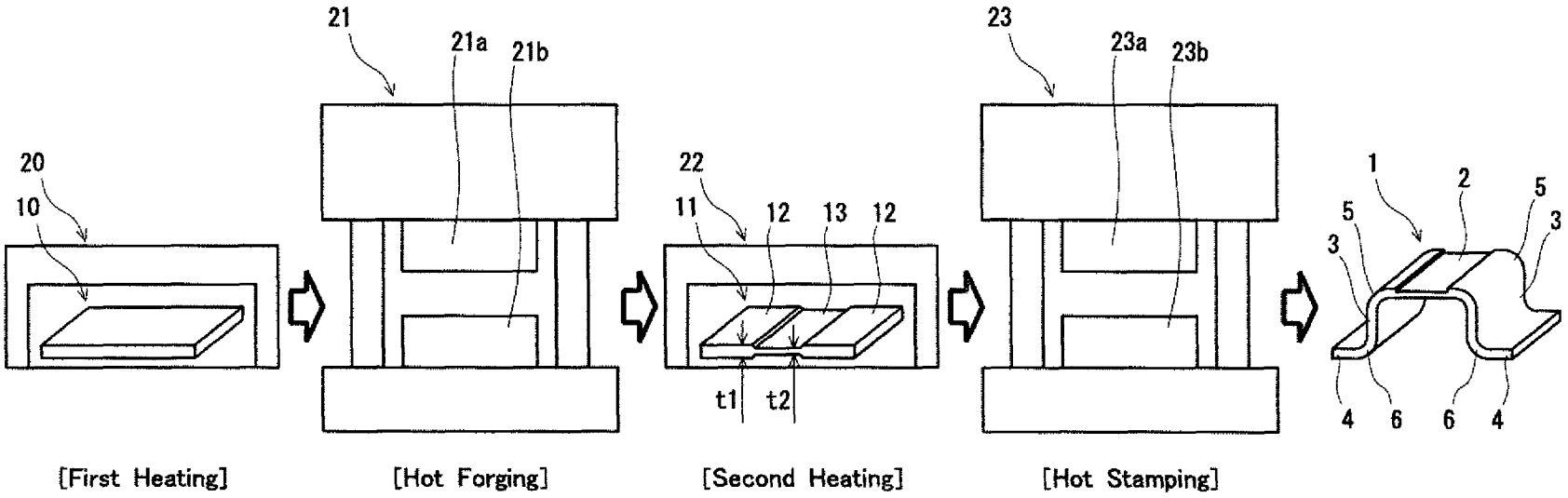
FIG. 2 is a view that schematically illustrates the process of the method of producing a press-formed product according to an embodiment of the present invention.

FIG. 1 is a flow chart illustrating a method of producing a press-formed product according to an embodiment of the present invention. FIG. 2 is a schematic diagram that illustrates the process of the method of producing a press-formed product according to an embodiment of the present invention. As illustrated in FIG. 1, the production method of the present embodiment includes a preparation step (step #5), a first heating step (step #10), a hot forging step (step #15), a second heating step (step #20) and a hot stamping step (step #25). The first heating step is a steel plate heating step. The second heating step is a varying-thickness steel plate heating step. Hereunder, each of these steps is described in detail referring to FIG. 1 and FIG. 2.

In the present embodiment, as illustrated in FIG. 2, a case of producing a press-formed product 1 whose cross-sectional shape is a hat shape is exemplified. The press-formed product 1 includes a top plate part 2, two vertical wall parts 3, two flange parts 4, two upper-side ridge line parts 5 and two lower-side ridge line parts 6. The upper-side ridge line parts 5 connect the top plate part 2 and the vertical wall parts 3. The lower-side ridge line parts 6 connect the vertical wall parts 3 and the flange parts 4.

The press-formed product 1 having the hat-shaped cross-section is applied, for example, to a bumper beam that is a vehicle component. Normally, a bumper beam is arranged so that the top plate part 2 faces inward or outward with respect to the vehicle body. In both cases, a load produced by an impact propagates through the vertical wall parts 3. The component performance required of a bumper beam is that, when an impact load is applied, the maximum load that can be withstood is high and the absorbed energy is large. Therefore, in a bumper beam, the portions which govern component performance are the vertical wall parts 3, the upper-side ridge line parts 5 and the lower-side ridge line parts 6, and the portions which have little influence on component performance are the top plate part 2 and the flange parts 4. Consequently, the plate thickness of the top plate part 2 and the flange parts 4 may be thin in comparison to the plate thicknesses of the vertical wall parts 3, the upper-side ridge line part 5 and the lower-side ridge line parts 6. If the strength of each part of the bumper beam is high and, in particular, the plate thickness of the top plate part 2 is thin, the bumper beam will have high strength and will also be light. In the press-formed product 1 illustrated in FIG. 2, the plate thickness of the top plate part 2 is noticeably thinner than the plate thickness of the other portions.

In the preparation step (step #5), a steel plate 10 is prepared as the starting material of the press-formed product 1. The steel plate 10 is cut out from a hot-rolled steel plate or cold-rolled steel plate or the like that has a constant thickness. The term "hot-rolled steel plate or cold-rolled steel plate that has a constant thickness" refers to a normal hot-rolled steel plate or cold-rolled steel plate, and in such a steel plate a plate thickness difference between the center in the width direction of a steel strip in a coil state after rolling and a position that is 25 mm from an edge is 0.2 mm or less. Variations in the plate thickness of the steel plate 10 (blank) that was cut out from the hot-rolled steel plate or cold-rolled steel plate are, naturally, not more than 0.2 mm. The thickness of the steel plate 10 is around 2.0 to 6.0 mm. In FIG. 2, the steel plate 10 that has been cut out in a rectangular shape to correspond to the shape of the press-formed product 1 having a hat-shaped cross-section is illustrated as an example.

In the first heating step (step #10), the steel plate 10 is inserted into a first heating furnace 20 and is heated to 950° C. or more. The steel plate 10 is heated in this manner because the steel plate 10 is to be subjected to hot forging in the next step. Preferably, the heating temperature of the steel plate 10 is 1000° C. or more. The upper limit of the heating temperature is not particularly limited as long as the heating temperature is less than or equal to the fusing point of the steel material of the steel plate 10. Preferably, the heating temperature of the steel plate 10 is not more than 1350° C.

In the hot forging step (step #15), the heated steel plate 10 is taken out from the first heating furnace 20, and the steel plate 10 is then supplied to a forging press apparatus 21 and subjected to forging. Press tooling 21*a* and 21*b* forming a pair on the upper and lower sides is used to perform the forging. A region at one part of the steel plate 10 is repeatedly rolled in the thickness direction by means of the press tooling 21*a* and 21*b*. The rolling region may be the entire area of the steel plate 10. The forging may be closed die forging or may be open die forging.

The steel plate 10 is formed into a varying-thickness steel plate 11 by the hot forging. The varying-thickness steel plate 11 has a thick-wall portion 12 and a thin-wall portion 13. Because the thick-wall portion 12 and the thin-wall portion 13 are formed by the hot forging in which the steel plate 10 is subjected to repeated rolling, the plate thickness difference between the thick-wall portion 12 and the thin-wall portion 13 can be made a large difference. In other words, it is possible for a plate thickness ratio "t1/t2" between a plate thickness t1 of the thick-wall portion 12 and a plate thickness t2 of the thin-wall portion 13 to be more than 1.8. In a tailored blank such as a TWB or a TRB, it is difficult to realize such a large plate thickness ratio. In FIG. 2, the varying-thickness steel plate 11 in which the plate thickness ratio "t1/t2" between the thick-wall portion 12 and the thin-wall portion 13 is not less than 1.8 and in which the thin-wall portion 13 is formed along the lengthwise direction at a center part in the width direction is illustrated as an example.

Further, because the thick-wall portion 12 and the thin-wall portion 13 are formed based on the shape of the press tooling 21*a* and 21*b* that can be freely designed, the size of each region of the thick-wall portion 12 and the thin-wall portion 13 is not limited. In a TRB, the size of each of these regions is limited to a size that is large to a certain extent. In addition, because the grain flow continues across the entire area of the thick-wall portion 12 and the thin-wall portion 13, a decrease in strength does not occur at a boundary between the thick-wall portion 12 and the thin-wall portion 13. This is not possible in the case of a TWB. Further, because the varying-thickness steel plate 11 is formed by hot forging, the internal structure of the varying-thickness steel plate 11, in particular the internal structure of the thin-wall portion 13 for which the roll draft is large, becomes compact and homogeneous.

Note that, in a case where the temperature of the steel plate 10 falls to less than a predetermined temperature (e.g., 950° C.) before the desired shape and dimensions of the varying-thickness steel plate 11 are obtained during forging, it suffices to return to the first heating step and heat the steel plate 10 to the predetermined temperature or more. Thereafter transition again to the hot forging step can be made.

After hot forging, it is desirable to cool the varying-thickness steel plate 11 to a temperature that is lower than the $A_{c3}$ transformation point. The reason is that, in a case where cooling is performed there is the advantage that the toughness of the end product (press-formed product) is superior in comparison to a case where cooling is not performed. In this case, the varying-thickness steel plate 11 may be cooled to room temperature. The cooling may be air-cooling or may be rapid cooling such as water-cooling.

Next, in the second heating step (step #20), the varying-thickness steel plate 11 is inserted into a second heating furnace 22 and is heated to a temperature that is not less than the $A_{c3}$ transformation point and not more than "the $A_{c3}$ transformation point+150° C.". This is because the varying-thickness steel plate 11 will be subjected to HS (press-working and quenching) in the next step. By undergoing the second heating step, the internal structure of the varying-thickness steel plate 11 becomes austenite. The second heating furnace 22 may be a furnace that is used exclusively for the second heating step, or the first heating furnace 20 that is used for the first heating step may be shared for use in the second heating step. However, the second heating step is not necessarily required. For example, in a case where, without performing cooling after the hot forging, the temperature of the varying-thickness steel plate 11 is held at a temperature that is not less than the $A_{c3}$ transformation point and not more than "the $A_{c3}$ transformation point+150° C.", the second heating step can be omitted. Naturally, in a case where cooling is performed after the hot forging, the second heating step is necessary. Even in a case where cooling is not performed after the hot forging, it is preferable for the varying-thickness steel plate 11 to undergo the second heating step. The reason is that in many cases the temperature of the varying-thickness steel plate 11 after hot forging is nonuniform or decreases to less than the $A_{c3}$ transformation point. If the temperature of the varying-thickness steel plate 11 that is supplied to the subsequent HS step is nonuniform or is less than the $A_{c3}$ transformation point, there is a risk that quenching defects will arise and that there will be places at which the desired strength is not obtained in the end product.

In the HS step (step #25), the varying-thickness steel plate 11 at a temperature that is not less than the $A_{c3}$ transformation point and not more than "the $A_{c3}$ transformation point+150° C." is fed into a hot stamping press apparatus 23 and is subjected to HS. In order to make the temperature of the varying-thickness steel plate 11 not less than the $A_{c3}$ transformation point and not more than "the $A_{c3}$ transformation point+150° C.", for example, it suffices to heat the varying-thickness steel plate 11 at the second heating furnace 22. The hot stamping press apparatus 23 is different from the forging press apparatus 21. Press tooling (e.g.: a die and a punch) 23*a* and 23*b* forming a pair on the upper and lower sides is used to carry out the HS. The varying-thickness steel plate 11 is subjected to press-working by the press tooling 23*a* and 23*b* to form the press-formed product 1, and the formed press-formed product 1 is cooled inside the press tooling 23*a* and 23*b*. The cooling of the press-formed product 1 inside the press tooling 23*a* and 23*b* is rapid cooling. The term "rapid cooling" refers to cooling at a cooling speed that transforms into martensite or bainite. In the case of performing another separate HS step after the current HS step, a structure mainly composed of bainite is allowed. The cooling is performed by circulating cooling water inside the press tooling 23*a* and 23*b* to thereby cause heat exchange between the press tooling 23*a* and 23*b* and the press-formed product 1. Alternatively, when pressing by the press tooling 23*a* and 23*b* is completed, cooling may be performed by directly emitting cooling water from the press tooling 23*a* and 23*b* onto the press-formed product 1.

The press-formed product 1 having the desired dimensions and shape is formed by the press-working in the HS step. At such time, in the example illustrated in FIG. 2, the thin-wall portion 13 of the varying-thickness steel plate 11 is formed into the top plate part 2 of the press-formed product 1. The thick-wall portion 12 of the varying-thickness steel plate 11 is formed into the upper-side ridge line parts 5, the vertical wall parts 3, the lower-side ridge line parts 6 and the flange parts 4 of the press-formed product 1. In addition, the press-formed product 1 is quenched by cooling in the HS step. The quenching causes the internal structure of the press-formed product 1 to transform from austenite into a hard phase such as martensite, and become a martensitic micro-structure (including a bainitic structure). Strictly speaking, in the internal structure of the press-formed product 1, the volume fraction of the martensitic micro-structure is 80% or more. By this means, as illustrated in FIG. 2, the press-formed product 1 in which the plate thickness of the top plate part 2 is thinner than the plate thickness of the other portions is obtained.

Because the press-formed product 1 formed as described above has a martensitic micro-structure throughout the whole area thereof, the strength of each part is high. For example, if the chemical composition of the steel plate 10 used as a starting material is adjusted, the tensile strength of the press-formed product 1 will be 1300 MPa or more. Further, the varying-thickness steel plate 11 having a compact internal structure is formed by hot forging. Because the press-formed product 1 is formed from the varying-thickness steel plate 11, the toughness of the press-formed product 1 is high. The reason is that coarsening of the grain size of austenite (γ grain size) that is the source of the martensite is suppressed by forging. Further, the varying-thickness steel plate 11 in which the plate thickness ratio is large is formed by hot forging. Because the press-formed product 1 is formed from the varying-thickness steel plate 11, the weight of the press-formed product 1 is light. Therefore, according to the production method of the present embodiment, the press-formed product 1 that has high strength and for which a reduction in weight is also possible can be produced.

An example of the chemical composition of the steel plate adopted as the starting material in the production method of the present embodiment is described hereunder. The steel plate according to the present embodiment that is described here is a steel plate in which the tensile strength after quenching is 1300 MPa or more. The chemical composition of the steel plate contains the following elements. The symbol "%" used in relation to an element means "mass %" unless specifically stated otherwise.

C: 0.15 to 0.60%

The strength after quenching mainly depends on the content of carbon (C) that governs the hardness of the martensite phase. Therefore, the C content is determined according to the required strength. To secure a tensile strength of 1300 MPa or more, the C content is 0.15% or more. More preferably, the C content is more than 0.20%. On the other hand, if the C content is too high, the toughness after quenching will decrease, and the risk of a brittle fracture occurring will increase. Therefore, the upper limit of the C content is 0.60%. A preferable upper limit of the C content is 0.50%.

Si: 0.001 to 2.0%

Silicon (Si) inhibits the formation of carbides during the course of cooling from the austenite phase until transformation to a low-temperature transformation phase. In other words, Si increases the strength after quenching without causing a deterioration in ductility, and in some cases improves ductility. This effect is not obtained if the Si content is too low. Therefore, the Si content is 0.001% or more. More preferably, the Si content is 0.05% or more. On the other hand, if the Si content is too high, the aforementioned effect will be saturated to cause economically disadvantageous, and in addition, a deterioration in the surface texture of the steel will be noticeable. Therefore, the Si content is 2.0% or less. More preferably, the Si content is 1.5% or less.

Mn: 0.5 to 3.0%

Manganese (Mn) increases the hardenability of the steel and stabilizes the strength after quenching. However, if the Mn content is too low, it is difficult to secure a tensile strength of 1300 MPa or more. Therefore, the Mn content is 0.5% or more. More preferably, the Mn content is 1.0% or more. If the Mn content is 1.0% or more, it is possible to secure a tensile strength of 1350 MPa or more. On the other hand, if the Mn content is too high, the band-like martensitic micro-structure will become nonuniform, and a deterioration in impact characteristics will be noticeable. Therefore, the Mn content is 3.0% or less. When taking into consideration the alloy cost and the like, an upper limit of the Mn content is 2.5%.

P: 0.05% or less

Although phosphorus (P) is generally an impurity that is unavoidably contained in the steel, P increases the strength by solid-solution strengthening. On the other hand, if the P content is too high, a deterioration in the weldability is noticeable. Further, in a case where the aim is to achieve a tensile strength of 2500 MPa or more, the risk of brittle fractures increases. Therefore, the P content is 0.05% or less. More preferably, the P content is 0.02% or less. The lower limit of P content is not particularly limited. To more surely obtain the aforementioned effect, the lower limit of the P content may be 0.003%.

S: 0.01% or less

Sulfur (S) is an impurity that is unavoidably contained in the steel, and binds with Mn or Ti to form sulfides, and precipitates. If the amount of the precipitates increases too much, interfaces between the precipitates and the main phase may become the starting point of fractures. Thus it is preferable for the S content to be low. Therefore, the S content is 0.01% or less. More preferably, the S content is 0.008% or less. The lower limit of the S content is not particularly limited. When taking the production cost into consideration, the lower limit of the S content may be 0.0015%, and more preferably may be 0.003%.

Sol. Al: 0.001 to 1.0%

Aluminum (Al) deoxidizes the steel to enhance the state of the steel material, and also improves the yield of carbonitride-forming elements such as Ti. If the Al content is too low, it is difficult to obtain the aforementioned effect. Therefore, the Al content is 0.001% or more. More preferably, the Al content is 0.015% or more. On the other hand, if the Al content is too high, a decline in weldability will be noticeable, and oxide inclusions in the steel will increase and a deterioration in the surface texture of the steel will be noticeable. Therefore, the Al content is 1.0% or less. More preferably, the Al content is 0.080% or less. In the present specification, the term "Al content" means the content of sol. Al (acid-soluble Al).

N: 0.01% or less

Nitrogen (N) is an impurity that is unavoidably contained in the steel. When taking weldability into consideration, it is preferable that the N content is low. On the other hand, if the N content is too high, a decrease in weldability will be noticeable. Therefore, the N content is 0.01% or less. More preferably, the N content is 0.006% or less. The lower limit of the N content is not particularly limited. When taking into consideration the production cost, the lower limit of the N content may be 0.0015%.

B: 0.01% or less

Boron (B) increases the low-temperature toughness of the steel. However, if the B content is too high, the hot workability deteriorates and hot rolling becomes difficult. Therefore, the B content is 0.01% or less. More preferably, the B content is 0.0050% or less. The lower limit of the B content is not particularly limited. In order to more surely obtain the aforementioned effect, the B content may be 0.0003% or more.

The balance of the chemical composition of the steel plate according to the present embodiment is Fe and impurities. Here, the term "impurities" refers to elements which, during industrial production of the steel plate, are mixed in from ore or scrap that is used as a raw material, or from the production environment or the like, and which are allowed within a range that does not adversely affect the steel plate of the present embodiment.

The aforementioned steel plate may further contain 0.03 to 1.0% in total of one or more types of element selected from the group consisting of Ti, Nb, V, Cr, Mo, Cu and Ni in lieu of a part of Fe. Each of these elements is an optional element, and each of these elements increases the hardenability of the steel, and stabilizes the toughness or strength of the steel after quenching. In a case where these optional elements are contained, if the content of the optional elements is too low, the aforementioned effects will not be effectively exhibited. Therefore, the lower limit of the total content of the optional elements is 0.03%. On the other hand, even if the content of the optional elements is too high, the aforementioned effect will be saturated. Therefore, the upper limit of the total content of the optional elements is 1.0%.

The $A_{c3}$ transformation point of the steel plate according to the present embodiment is calculated, for example, by the following Formula (1).

$$A_{c3}=910-203\times\sqrt{C})-15.2\times Ni+44.7\times Si+104\times V+31.5\times Mo-30\times Mn-11\times Cr-20\times Cu+700\times P+400\times Al+50\times Ti \quad (1)$$

Where, a content (mass %) of a corresponding element is substituted for each symbol of an element in Formula (1). Al means sol. Al.

Production Line

Figure 3:
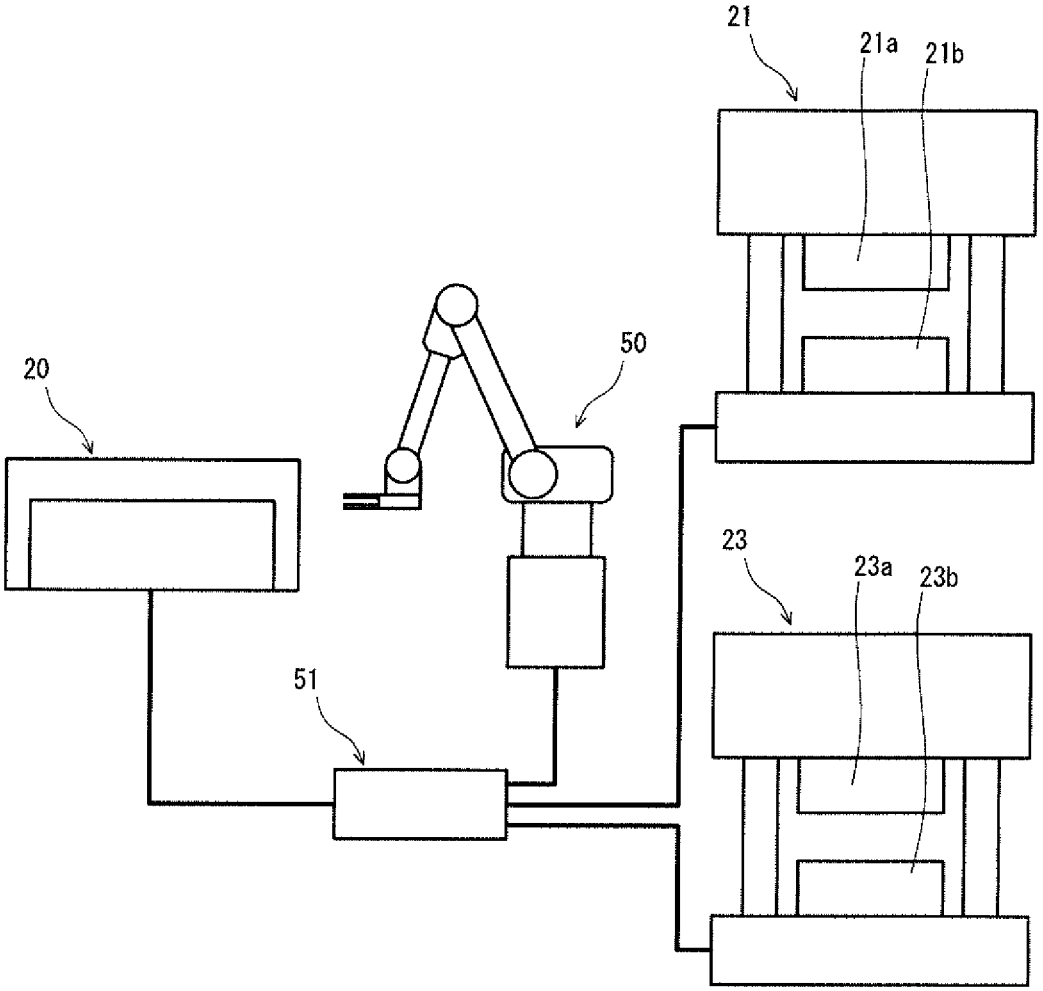
FIG. 3 is a schematic diagram illustrating an example of a press-formed product production line.

FIG. 3 is a schematic diagram illustrating an example of a press-formed product production line. Referring to FIG. 3, the press-formed product production line includes the forging press apparatus 21, the HS press apparatus 23, at least one heating furnace 20 and at least one manipulator 50. In practice, the production line also includes a control unit 51 for controlling all of these apparatuses 21, 23, 20 and 50.

Forging Press Apparatus

The forging press apparatus 21 is used in the aforementioned hot forging step. The forging press apparatus 21 forges a varying-thickness steel plate by repeatedly beating a high-temperature steel plate (blank) using the press tooling 21*a* and 21*b*. It is desirable for the forging press apparatus 21 to have a cooling apparatus for cooling the forged varying-thickness steel plate. The reason for this is to obtain an end product (press-formed product) that is excellent in toughness.

Hot Stamping Press Apparatus

The HS press apparatus 23 is used in the aforementioned HS step. The HS press apparatus 23 subjects a high-temperature varying-thickness steel plate to press-working by means of the press tooling 23*a* and 23*b* to thereby form a press-formed product. In addition, in the HS press apparatus 23, the press-formed product is cooled inside the press tooling 23*a* and 23*b* that are cooled, or is cooled inside the press tooling 23*a* and 23*b* by means of cooling water emitted from the press tooling 23*a* and 23*b*, and thereby quenched.

In this case, in order to obtain a press-formed product having a desired strength from a varying-thickness steel plate including a thick-wall portion and a thin-wall portion by HS, it is desirable that the cooling speed and cooling end-point temperature are appropriately controlled for the press-formed product that was formed at a temperature that is not lower than the $A_{c3}$ transformation point. In the press-formed product, the thick-wall portion is more difficult to cool than the thin-wall portion. The reason is that the heat capacity of the thick-wall portion is large in comparison to the thin-wall portion. Therefore, it is desirable to subject the thick-wall portion to stronger cooling than the thin-wall portion.

In the thick-wall portion, formation of the desired hard metal micro-structure will be insufficient unless the intended cooling speed is applied. In such a case, in the press-formed product, the metal micro-structure will be nonuniform, and the strength will also be nonuniform. In addition, depending on differences in thermal contraction and differences in phase transformation strain that arises because of differences in the metal micro-structure, it may be difficult to obtain the intended dimensional accuracy of the shape. Further, if an interface part between the thick-wall portion and the thin-wall portion is cooled at a faster speed than the thick-wall portion and the thin-wall portion, the strength at the interface part will be higher than at other parts. In this case, there is a risk that when an impact load is applied to the press-formed product, the interface part will rupture due to secondary deformation.

Thus, it is desirable to intensify cooling of the thick-wall portion during HS. An example of a HS press apparatus that is capable of dealing with the above described situation is described hereunder.

Figure 4A:
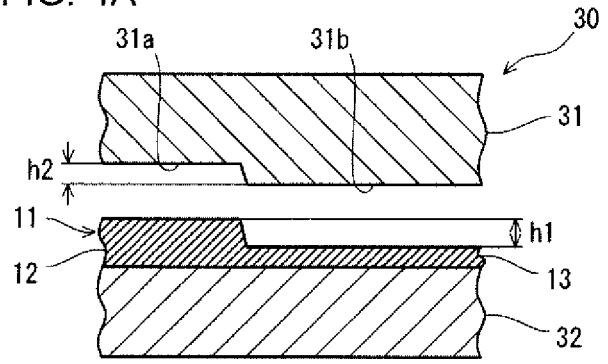
FIG. 4A is a cross-sectional view illustrating a state in an initial stage during hot stamping according to a first specific example.
Figure 4B:
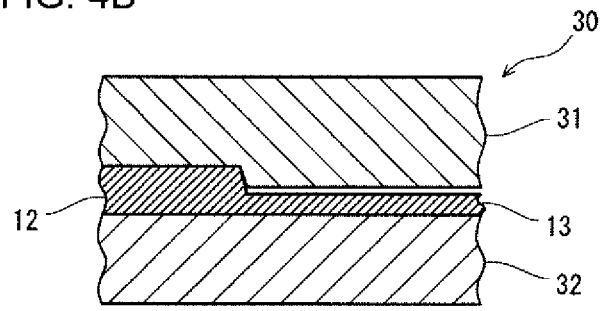
FIG. 4B is a cross-sectional view illustrating a state in a middle stage during hot stamping according to the first specific example.
Figure 4C:
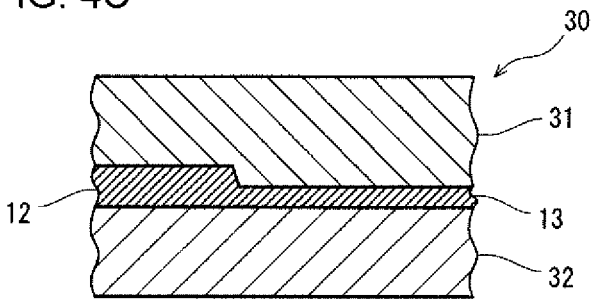
FIG. 4C is a cross-sectional view illustrating a state in a final stage during hot stamping according to the first specific example.

FIG. 4A to FIG. 4C are cross-sectional views that illustrate a first specific example of a HS press apparatus. FIG. 4A illustrates a state in an initial stage of working, FIG. 4B illustrates a state in a middle stage of working, and FIG. 4C illustrates a state in a final stage of working. A HS press apparatus 30 shown in FIG. 4A to FIG. 4C includes an upper die 31 and a lower die 32. The upper die 31 includes a first face 31*a* that corresponds to the thick-wall portion 12, and a second face 31*b* that corresponds to the thin-wall portion 13. A height h2 of a step height between the first face 31*a* and the second face 31*b* in the upper die 31 is less than a height h1 of a step height between the thick-wall portion 12 and the thin-wall portion 13 in the varying-thickness steel plate 11. The upper die 31 is supported by an upper die holder (not shown in the drawings). Cooling water circulates inside the upper die 31.

Referring to FIG. 4A, the high-temperature varying-thickness steel plate 11 including the thick-wall portion 12 and the thin-wall portion 13 is placed on the lower die 32. Referring to FIG. 4B, when the upper die holder descends, first, the first face 31*a* of the upper die 31 contacts the thick-wall portion 12 of the varying-thickness steel plate 11. When the upper die holder descends further, the thick-wall portion 12 is worked by the first face 31*a*.

When the upper die holder descends further, as illustrated in FIG. 4C, the second face 31*b* of the upper die 31 contacts the thin-wall portion 13 of the varying-thickness steel plate 11. When the upper die holder further descends as far as the bottom dead center, the thin-wall portion 13 is worked by the second face 31*b*.

Figure 5A:
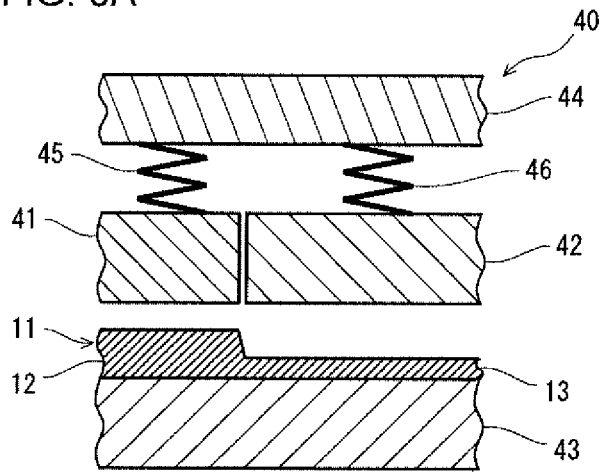
FIG. 5A is a cross-sectional view illustrating a state in an initial stage during hot stamping according to a second specific example.
Figure 5B:
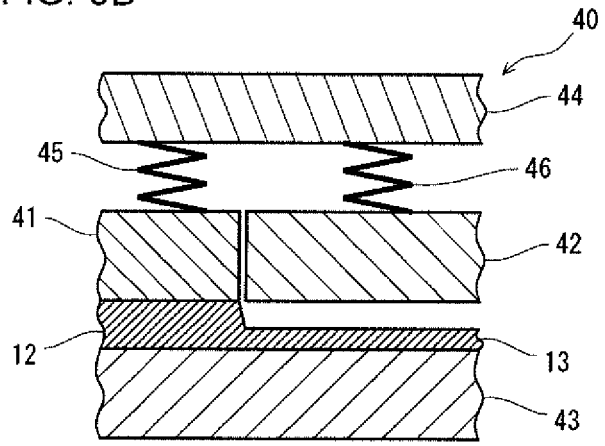
FIG. 5B is a cross-sectional view illustrating a state in a middle stage during hot stamping according to the second specific example.
Figure 5C:
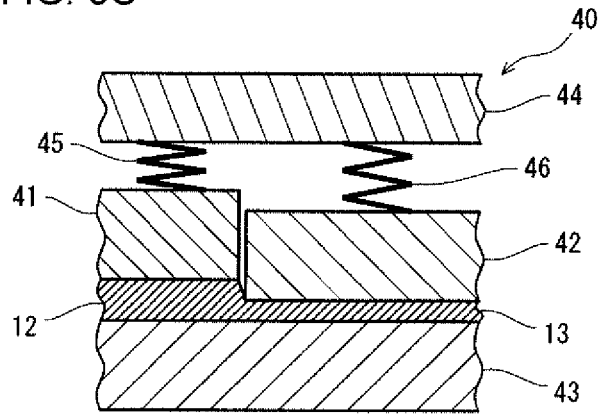
FIG. 5C is a cross-sectional view illustrating a state in a final stage during hot stamping according to the second specific example.

FIG. 5A to FIG. 5C are cross-sectional views illustrating a second specific example of the HS press apparatus. FIG. 5A illustrates a state in an initial stage of working, FIG. 5B illustrates a state in a middle stage of working, and FIG. 5C illustrates a state in a final stage of working. A HS press apparatus 40 shown in FIG. 5A to FIG. 5C includes a first upper die 41, a second upper die 42 and a lower die 43. The first upper die 41 is disposed at a position corresponding to the thick-wall portion 12. The second upper die 42 is disposed at a position corresponding to the thin-wall portion 13. The first upper die 41 is supported by an upper die holder 44 via a first pressurization member 45. The second upper die 42 is supported by the upper die holder 44 via a second pressurization member 46. The first and second pressurization members 45 and 46 are hydraulic cylinders or springs or the like. Cooling water circulates inside the first and second upper dies 41 and 42.

Referring to FIG. 5A, the high-temperature varying-thickness steel plate 11 including the thick-wall portion 12 and the thin-wall portion 13 is placed on the lower die 43. Referring to FIG. 5B, when the upper die holder 44 descends, first, the first upper die 41 contacts the thick-wall portion 12 of the varying-thickness steel plate 11. When the upper die holder 44 descends further, the first pressurization member 45 contracts while applying pressure to the first upper die 41, and the thick-wall portion 12 is worked by the first upper die 41.

When the upper die holder 44 descends further, as illustrated in FIG. 5C, the second upper die 42 contacts the thin-wall portion 13 of the varying-thickness steel plate 11. When the upper die holder 44 further descends as far as the bottom dead center, the second pressurization member 46 contracts while applying pressure to the second upper die 42, and the thin-wall portion 13 is worked by the second upper die 42.

In each of the first specific example and second specific example, during HS, working of the thick-wall portion 12 precedes working of the thin-wall portion 13. Therefore, cooling of the thick-wall portion 12 precedes cooling of the thin-wall portion 13. As a result, it is possible to intensify cooling of the thick-wall portion 12.

Heating Furnace

Referring to FIG. 3, the heating furnace 20 is used in the aforementioned first heating step and second heating step. The heating furnace 20 heats the steel plate (blank) prior to hot forging. Further, the heating furnace 20 heats the varying-thickness steel plate obtained by the hot forging. The steel plate is heated to 950° C. or more. The varying-thickness steel plate is heated to a temperature that is not less than the $A_{c3}$ transformation point and not more than "the $A_{c3}$ transformation point+150° C.". The production line may have one heating furnace 20, and the heating furnace 20 may be used in a shared manner for the first and second heating steps. However, in some cases the heating temperature that is the target of the first heating step and the heating temperature that is the target of the second heating step do not match. Therefore, in a case where use of a single heating furnace 20 is shared, it is desirable to divide the inside of the heating furnace 20 into two or more sections in which the target heating temperatures are different from each other. Naturally, the production line may also include two or more heating furnaces 20, with the respective heating furnaces 20 being used exclusively for respective heating steps. In order to make the production line compact, it is desirable to divide the inside of the heating furnace 20 into shelves that are at multiple levels, and for a steel plate or a varying-thickness steel plate to be housed on the respective shelves.

Manipulator

Because the steel plate (blank) and varying-thickness steel plate (hereunder, these are also referred to collectively as "steel plates") are heated to 900° C. or more, humans cannot directly handle the steel plates. Therefore, conveyance of the steel plates is performed by a machine. The steel plates are inserted between the upper and lower press tooling of the forging press apparatus 21 and are taken out therefrom. In addition, the steel plates are inserted between the upper and lower press tooling of the HS press apparatus 23 and are taken out therefrom. Therefore, conveyance of the steel plates is performed by a manipulator 50 (conveyance robot) that can lift the steel plates.

The conveyance operations that the manipulator 50 performs are as follows:

- Conveyance from the heating furnace 20 to the forging press apparatus 21
- Conveyance from the forging press apparatus 21 to the heating furnace 20 in a case where reheating is necessary
- Conveyance from the forging press apparatus 21 to the heating furnace 20 after hot forging is completed
- Conveyance from the heating furnace 20 to the HS press apparatus 23
- Taking out the press-formed product from the HS press apparatus 23

The production line may include one manipulator 50, and the manipulator 50 may be responsible for all of the conveyance operations. Alternatively, the production line may include a plurality of the manipulators 50, and the conveyance operations may be distributed between the respective manipulators 50. The movable range of the manipulator 50 is set so as to include the conveyance destination and conveyance origin for each of the apparatuses 21, 23 and 20.

Control Unit

The temperature of a blank that has been taken out from the heating furnace 20 gradually falls. Therefore, it is necessary to manage the time period for which the blank is conveyed by the manipulator 50 and also the heating temperature of the heating furnace 20. Furthermore, it is necessary that the operations to take out steel plates and operations to insert steel plates by the manipulator 50 are performed in coordination with the operations of the heating furnace 20 and press apparatuses 21 and 23. For these reasons, each of the apparatuses 21, 23 and 20 included in the production line is controlled by the control unit 51.

The control unit 51 outputs signals for controlling opening and closing of the door of the heating furnace 20 and operations of the manipulator 50. A plurality of steel plates (blanks) or steel plates of varying thickness are housed inside the heating furnace 20. The housing status of the respective steel plates in the heating furnace 20 is recorded in a memory of the control unit 51. Whether or not to take steel plates out from the heating furnace 20 is determined by the control unit 51 based on the in-furnace temperature of the heating furnace 20 and the time periods for which the respective steel plates have been in the heating furnace 20. The control unit 51 has, for example, the following functions:

- Determining whether or not to take out a steel plate from the heating furnace 20
- Operation control of the manipulator 50 from the heating furnace 20 to the forging press apparatus 21
- Management of free space inside the heating furnace 20
- Operation control of the manipulator 50 from the forging press apparatus 21 to the heating furnace 20 in a case where reheating is necessary
- Operation control of the manipulator 50 from the forging press apparatus 21 to the heating furnace 20 after hot forging is completed
- Determining whether or not to take out a varying-thickness steel plate from the heating furnace 20
- Operation control of the manipulator 50 from the heating furnace 20 to the HS press apparatus 23
- Operation control of the manipulator 50 that takes out a press-formed product from the HS press apparatus 23

In order to execute these functions, signals such as a working preparation completion signal and a working completion signal are input to the control unit 51 from the forging press apparatus 21 and the HS press apparatus 23. The operation control of the manipulator 50 may be control of the position of the manipulator 50 from moment to moment. Further, the operation control of the manipulator 50 may be control whereby the manipulator 50 performs a predetermined operation in response to output of a signal from the control unit 51. In addition, the control unit 51 may be equipped with a function that changes a temperature at which to take out a blank from the heating furnace 20 according to the ambient air temperature. The control unit 51 may also be equipped with a function that changes a conveyance time period for conveyance from the heating furnace 20 to the forging press apparatus 21 and the HS press apparatus 23 according to the ambient air temperature.

Examples

Numerical analysis tests described hereunder were performed to verify the effects of the method of producing a press-formed product of the present embodiment. Specifically, based on the assumption of use for a bumper beam, two kinds of analytical models having a hat-shaped cross-section were prepared. For each model, a numerical analysis that simulated a three-point bending crush test was performed. In general, a three-point bending crush test is used to evaluate the performance of a bumper beam.

Test Condition

Figure 6A:
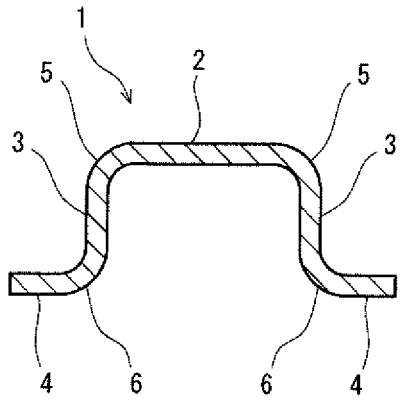
FIG. 6A is a cross-sectional view that schematically illustrates an analytical model of a Comparative Example used in a bending test of the Examples.
Figure 6B:
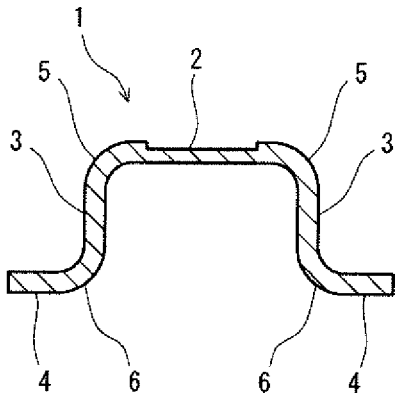
FIG. 6B is a cross-sectional view that schematically illustrates an analytical model of an Inventive Example of the present invention used in a bending test of the Examples.

FIG. 6A and FIG. 6B are cross-sectional views that schematically illustrate analytical models used in the bending test of the Examples. FIG. 6A illustrates an analytical model of a Comparative Example, and FIG. 6B illustrates an analytical model of an Inventive Example of the present invention. As illustrated in FIG. 6A, a model A of the Comparative Example was formed with a constant plate thickness of 2.0 mm over the whole area thereof. As illustrated in FIG. 6B, in a model B of the Inventive Example of the present invention, the plate thickness of a top plate part 2 was made 1.0 mm that was one-half of the plate thickness of the other portions.

The tensile strength was made 1300 MPa in both model A and model B. In each of model A and model B, a common closing plate (not shown in the drawings) was joined to the flange parts 4, and the space between the flange parts 4 was closed by means of the closing plate.

Model A and model B were each supported at two points from the closing plate side. The interval between the support points of the respective models A and B was 800 mm. An impactor was caused to impact at the center of the support points of the respective models A and B from the top plate part 2 side to thereby crush the respective models A and B. The radius of curvature at a front end part of the impactor was 150 mm. The impact velocity of the impactor was 9 km/h.

Test Results

Figure 7:
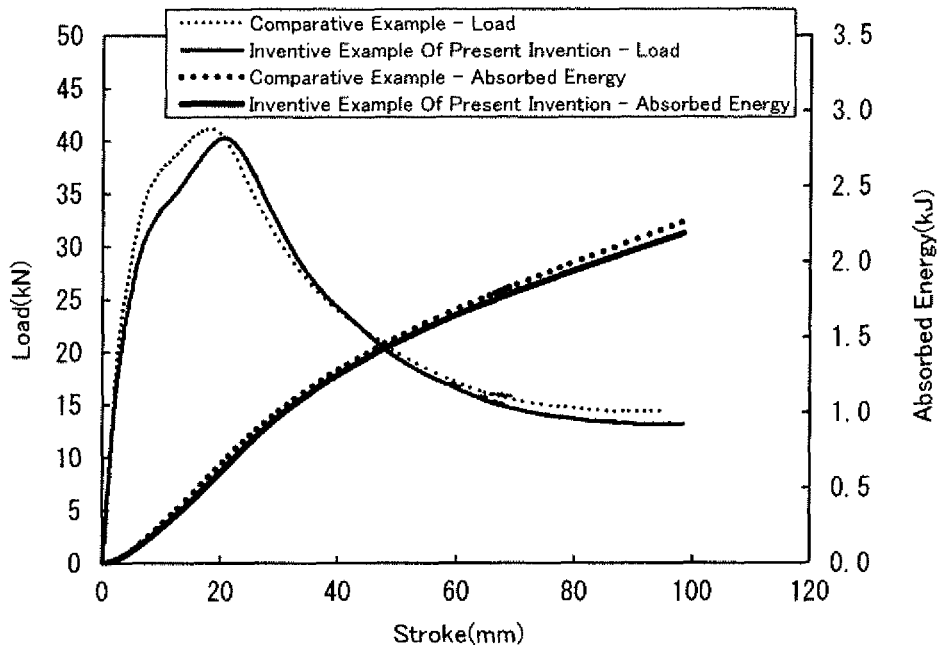
FIG. 7 is a view showing a summary of test results of the Examples.

FIG. 7 is a view that summarizes the test results of the Examples. The facts described hereunder were found based on the results shown in FIG. 7.

There was almost no difference in the distribution of the load in accordance with the stroke of the impactor between model A of the Comparative Example and model B of the Inventive Example of the present invention. In other words, the maximum load and absorbed energy when the impact load was applied were nearly equal for model A of the Comparative Example and model B of the Inventive Example of the present invention. In spite of this, model B of the Inventive Example of the present invention had the lighter weight. Based on these facts, it was found that the influence of the plate thickness of the top plate part 2 on the component performance was minor, and that by thinning the plate thickness of the top plate part 2, the weight can be lightened while securing the component performance.

The present invention is not limited to the embodiment described above, and various modifications may be made within a range that does not deviate from the gist of the present invention.

INDUSTRIAL APPLICABILITY

The method of producing a press-formed product of the present invention can be effectively utilized in the production of a press-formed product for an automobile for which enhanced strength is required.

REFERENCE SIGNS LIST

1 Press-formed Product
2 Top Plate Part
3 Vertical Wall Part
4 Flange Part
5 Upper-side Ridge Line Part
6 Lower-side Ridge Line Part
10 Steel Plate
20 First Heating Furnace
21 Forging Press Apparatus
21*a*, 21*b* Press Tooling
11 Varying-thickness steel plate
12 Thick-wall Portion
13 Thin-wall Portion
t1 Plate Thickness Of Thick-wall Portion
t2 Plate Thickness Of Thin-wall Portion
22 Second Heating Furnace
23, 30, 40 Hot Stamping Press Apparatus
23*a*, 23*b* Press Tooling
50 Manipulator
51 Control Unit

The invention claimed is:

1. A method of producing a press-formed product, comprising:

heating a steel plate to 950° C. or more, forging the steel plate using a first press apparatus to form a varying-thickness steel plate, water cooling the varying-thickness steel plate, heating the varying-thickness steel plate to a temperature that is not less than an $A_{c3}$ transformation point and not more than an $A_{c3}$ transformation point+150° C., and using a second press apparatus different from the first press apparatus, forming the varying-thickness steel plate into a press-formed product by means of a press tooling of the second press apparatus, and cooling the press-formed product inside the press tooling.

2. The method of producing a press-formed product according to claim 1, wherein:

the varying-thickness steel plate includes a portion having a large thickness and a portion having a small thickness, and a ratio t1/t2 between a plate thickness t1 of the portion having a large thickness and a plate thickness t2 of the portion having a small thickness is more than 1.8.

3. The method of producing a press-formed product according to claim 1, wherein:

a tensile strength of the press-formed product is 1300 MPa or more.

4. The method of producing a press-formed product according to claim 1, wherein:

the steel plate consists of, by mass %, C: 0.15 to 0.60%, Si: 0.001 to 2.0%, Mn: 0.5 to 3.0%, P: 0.05% or less, S: 0.01% or less, sol. Al: 0.001 to 1.0%, N: 0.01% or less and B: 0.01% or less, with the balance being Fe and impurities.

5. The method of producing a press-formed product according to claim 4, wherein:

the steel plate comprises, in lieu of a part of Fe, 0.03 to 1.0% in total of one or more types of element selected from the group consisting of Ti, Nb, V, Cr, Mo, Cu and Ni.

* * * * *